US009926753B2

(12) United States Patent
Magnuson et al.

(10) Patent No.: US 9,926,753 B2
(45) Date of Patent: Mar. 27, 2018

(54) PARKING SYSTEM FOR A PIPE RACKER ON A DRILLING RIG

(71) Applicant: Nabors Industries, Inc., Houston, TX (US)

(72) Inventors: Christopher Magnuson, Houston, TX (US); Marvin Brown, Tomball, TX (US); Eric Deutsch, Houston, TX (US); Predrag Radovanovic, Belgrade (RS); Miodrag Djuric, Belgrade (RS)

(73) Assignee: Nabors Industries, Inc., Houston, TX (US)

( * ) Notice: Subject to any disclaimer, the term of this patent is extended or adjusted under 35 U.S.C. 154(b) by 343 days.

(21) Appl. No.: 14/279,986

(22) Filed: May 16, 2014

(65) Prior Publication Data

US 2015/0330162 A1 Nov. 19, 2015

(51) Int. Cl.
*E21B 19/14* (2006.01)

(52) U.S. Cl.
CPC ..... *E21B 19/14* (2013.01); *Y10T 29/49842* (2015.01)

(58) Field of Classification Search
CPC ..... E21B 19/14; E21B 19/20; E21B 15/00; B61C 11/04
USPC ..... 414/22.51–22.71; 104/167; 105/29.1, 105/29.2
See application file for complete search history.

(56) References Cited

U.S. PATENT DOCUMENTS 3,592,347 A * 7/1971 Kelly ..... E21B 19/14 114/264
3,718,266 A * 2/1973 Donnally ..... E21B 33/064 104/121
3,750,898 A * 8/1973 Ancey ..... E21B 19/155 414/22.69
3,978,993 A 9/1976 Howard
4,109,800 A 8/1978 Howard et al.
4,224,005 A 9/1980 Dysarz
4,610,315 A 9/1986 Koga et al.
4,621,974 A * 11/1986 Krueger ..... E21B 19/20 211/70.4
4,715,761 A * 12/1987 Berry ..... E21B 19/14 104/35
4,765,401 A * 8/1988 Boyadjieff ..... E21B 19/20 166/77.53

(Continued)

OTHER PUBLICATIONS

International Search Report and Written Opinion issued for PCT/US2015/021799 dated Jul. 7, 2015, 17 pgs.

(Continued)

*Primary Examiner* — Anna M Momper
*Assistant Examiner* — Lynn E Schwenning
(74) *Attorney, Agent, or Firm* — Haynes and Boone, LLP

(57) ABSTRACT

Apparatus and methods include a parking system for a drilling rig. The parking system includes a first track portion extending along a pathway between a well center and a V-door on a drilling rig and a second track portion extending in a transverse direction relative to the first track portion. A trolley is configured to carry a racking device and move along at least a portion of the first track portion and the second track portion between a position in the pathway between well center and the V-door on a drilling rig and a position offline and out of the pathway between well center and the V-door on a drilling rig.

25 Claims, 13 Drawing Sheets

(56) References Cited

U.S. PATENT DOCUMENTS

| | | | | |
|---|---|---|---|---|
| 4,973,219 | A * | 11/1990 | Brickner | B65G 63/004 104/88.05 |
| 5,244,329 | A | 9/1993 | McGill et al. | |
| 5,437,527 | A | 8/1995 | McGill et al. | |
| 6,098,550 | A * | 8/2000 | Tsuboi | B61B 13/02 105/127 |
| 6,220,174 | B1 * | 4/2001 | Gudel | B61B 13/02 105/29.1 |
| 7,246,983 | B2 | 7/2007 | Zahn et al. | |
| 7,699,122 | B2 * | 4/2010 | Eriksen | E21B 19/14 175/52 |
| 7,802,636 | B2 * | 9/2010 | Childers | E21B 19/20 166/380 |
| 8,206,074 | B2 * | 6/2012 | Benedict | B65G 63/004 414/140.3 |
| 8,602,709 | B2 * | 12/2013 | Habegger | E04H 6/20 414/238 |
| 8,961,093 | B2 * | 2/2015 | Springett | E21B 19/14 211/70.4 |
| 2003/0106695 | A1 | 6/2003 | Fikes et al. | |
| 2008/0148992 | A1 * | 6/2008 | Bambrick | B61C 13/04 105/30 |
| 2009/0126941 | A1 | 5/2009 | Laitolais, Jr. et al. | |
| 2010/0303586 | A1 | 12/2010 | Hankins et al. | |
| 2011/0079434 | A1 | 4/2011 | Belik et al. | |

OTHER PUBLICATIONS

Written Opinion dated Sep. 5, 2017 for Singapore Application No. 11201609291S (8 pgs.).

* cited by examiner

PARKING SYSTEM FOR A PIPE RACKER ON A DRILLING RIG

TECHNICAL FIELD

The present disclosure is directed to systems, devices, and methods for the manipulation, assembly and moving of tubulars within a derrick or mast in oil and gas drilling systems. More specifically, the present disclosure is directed to systems, devices, and methods for parking a pipe racking system in a position that is offline or displaced from a position between a V-door and well center on a drilling rig.

BACKGROUND OF THE DISCLOSURE

The exploration and production of hydrocarbons require the use of numerous types of tubulars also referred to as pipe. Tubulars include but are not limited to drill pipes, casings, and other threadably connectable elements used in well structures. Strings of joined tubulars, or drill strings, are often used to drill a wellbore and, with regards to casing, prevent collapse of the wellbore after drilling. These tubulars are normally assembled in groups of two or more, commonly known as "stands" to be vertically stored in the derrick or mast. The derrick or mast may include a storing structure commonly referred to as a fingerboard. Fingerboards typically include a plurality of vertically elongated support structures or "fingers" each capable of receiving a plurality of "stands."

Rotary Drilling and Top Drive drilling systems often use these stands, instead of single tubulars, to increase efficiency of drilling operations by reducing the amount of connections required to build the drill string in or directly over the wellbore. However, the manipulation of tubulars from a horizontal to a vertical position, assembly of stands and presentation of stands between the fingerboard and well center are dangerous and can be rather inefficient operations.

The ability to build stands while simultaneously drilling allows numerous activities to be conducted simultaneously, thus gaining efficiency. However, due to the small rig floors and mobile nature of land rigs, both automated rackers and offline standbuilding systems have not been possible in the land rigs. In addition, safety of the rig crew is a critical aspect of drilling operations and specifically the removal of rig personnel from the rig floor has been a goal in the industry. One known system described in patent application 2010/0303586 allows for the manipulation of tubulars. The system however, still requires rig personnel to tail the tubulars on the rig floor to ensure proper positions of stands in the setback. Another known system described in U.S. Pat. No. 7,967,541, while an improvement to the system of 2010/0303586 by eliminating rig personnel from the rig floor during racking operations, still requires rig personnel to build stands. Neither of the systems in the references identified above assists in the make-up of stands. Both systems do not assist in the manipulations of tubulars from the catwalk to well center or an offline mousehole thus requiring rig personnel to utilize winches for the manipulation of tubulars from the horizontal to vertical position.

The present disclosure is directed to systems and methods that overcome one or more of the shortcomings of the prior art.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 6-1 is a schematic of an exemplary apparatus according to one or more aspects of the present disclosure showing a portion of the lower track portion of FIG. 4.

FIG. 6-2 is a schematic of an exemplary apparatus according to one or more aspects of the present disclosure showing a portion of the lower track portion of FIG. 4.

FIG. 9-1 is a schematic of an exemplary apparatus according to one or more aspects of the present disclosure showing a portion of an upper track portion.

FIG. 9-2 is a schematic of an exemplary apparatus according to one or more aspects of the present disclosure showing a portion of the upper track portion of FIG. 9-1.

FIG. 9-3 is a schematic of an exemplary apparatus according to one or more aspects of the present disclosure showing a portion of the upper track portion of FIG. 9-1.

FIG. 9-4 is a schematic of an exemplary apparatus according to one or more aspects of the present disclosure showing a portion of the upper track portion of FIG. 9-1.

DETAILED DESCRIPTION

Figure 1:
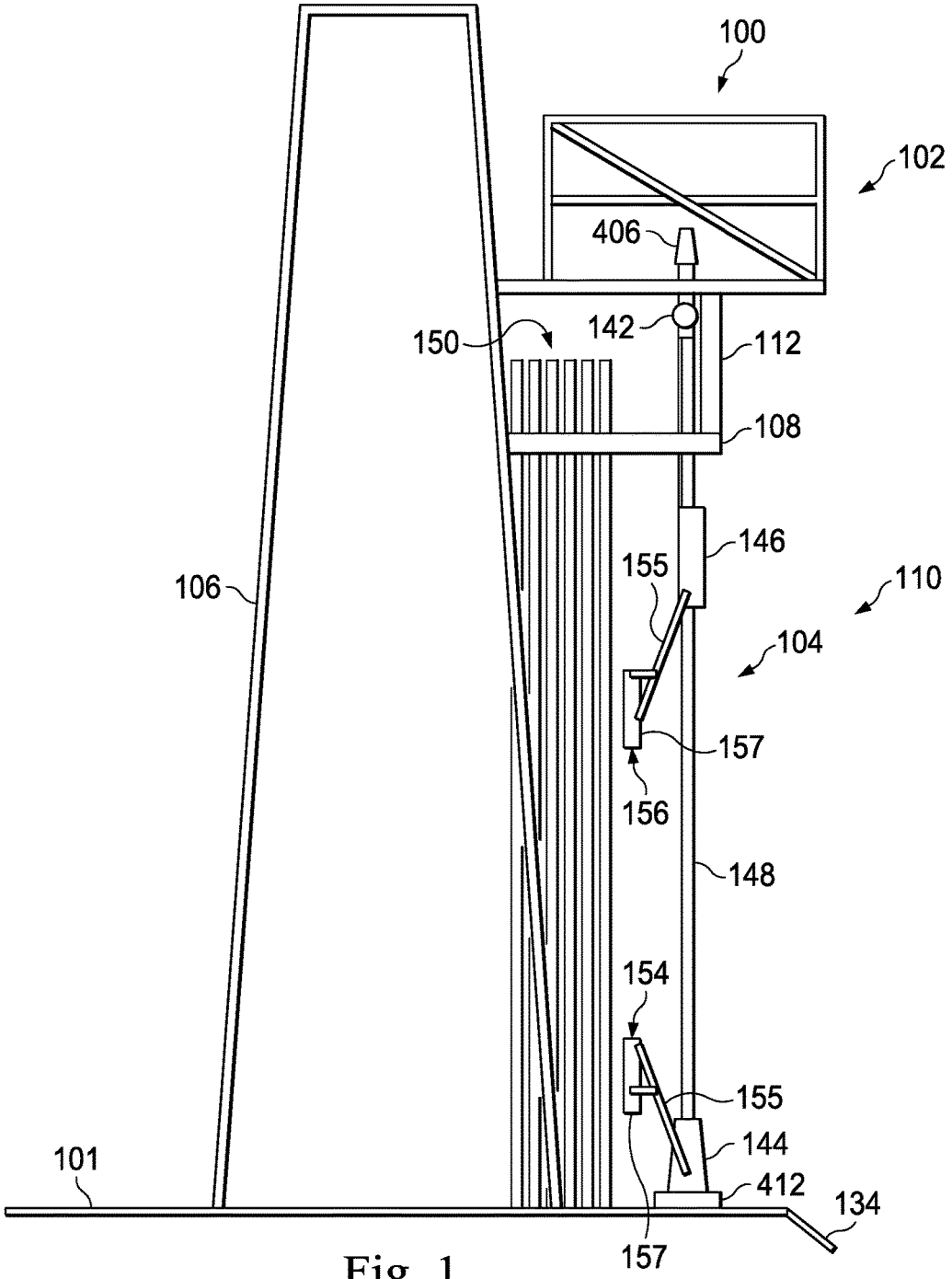
FIG. 1 is a schematic of an exemplary apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Figure 2:
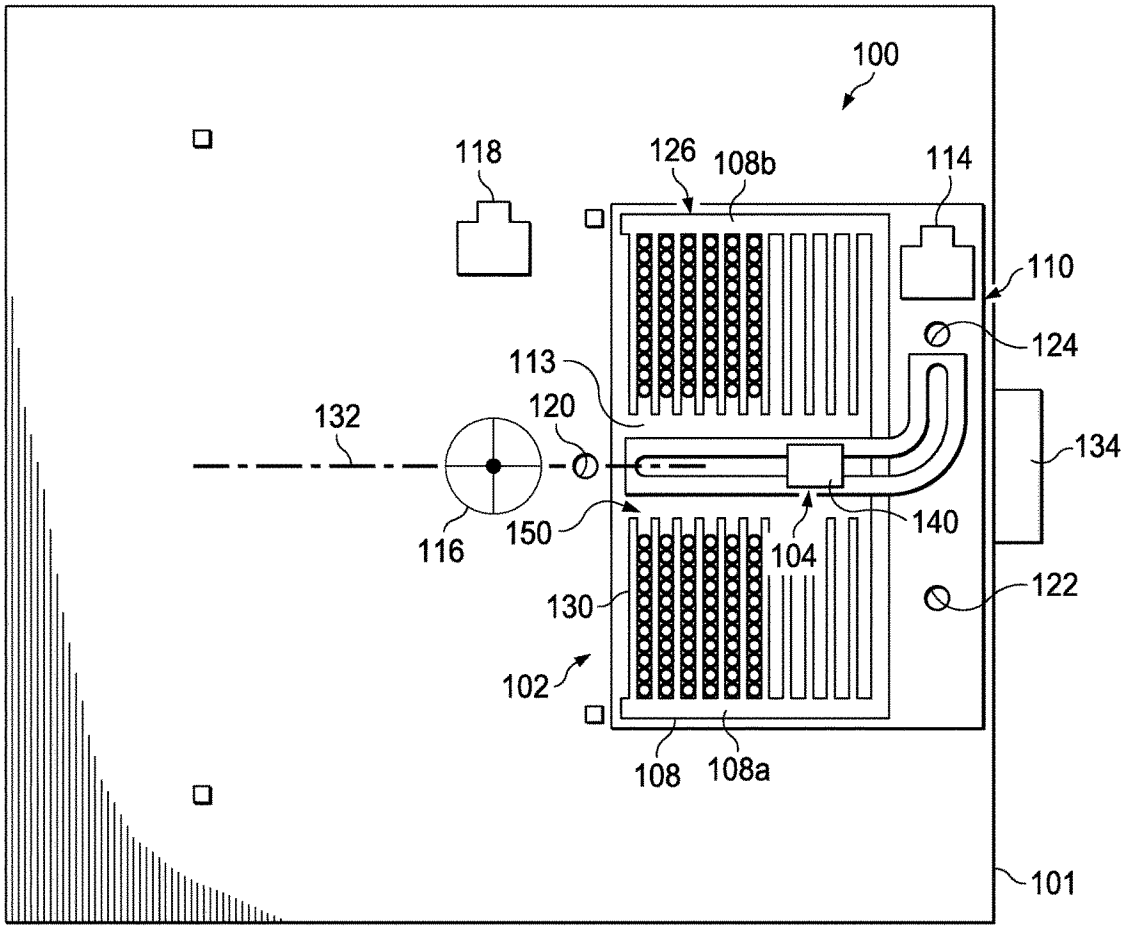
FIG. 2 is a schematic of a top view of the apparatus of FIG. 1 according to one or more aspects of the present disclosure.

The systems, devices, and methods described herein may be used to transfer a pipe racker device to different positions about a mobile drilling rig. For example, the systems, devices, and methods may be used to move a pipe racker from a position online to a position offline, such as a parked or stowed position. As used herein, the term "online" is meant to include a position that is along the pathway extending between a well center and a V-door of a drilling rig. In FIG. 2, this pathway is represented by the dashed line 132, extending between a well center 116 and a V-door 134 providing access to the rig floor. As used herein, the term "offline" is meant to include a position that is offset from the pathway represented by the online position. This includes positions laterally offset in a manner that clears the pathway between well center and the V-door of the drilling rig. This enables other activities to take place in the space of the rig between well center and the V-door. In some embodiments, this allows the pipe racker to build a stand offline, and travel from a position offline to a position online while carrying a pipe or stand.

Accordingly, while existing column rackers are limited to one direction of movement for their column, e.g., along the pathway between the V-door and the well center, the systems disclosed herein move a racker device, such as a column racker, to a position offline. To do this, some of the systems and devices are arranged to move the racker device in two directions, such as in both x and y-directions. Movement in the x and y-directions is possible due to the arrangement of support structures that carry the racker device. In some embodiments, this support structure is located at an elevation above the fingerboard allowing clearance between the upper support structures and stands as they may already exist. Unlike the systems disclosed herein, traditional column rackers are positioned at the fingerboard level and are limited to movement in only one direction. Some embodiments herein permit retro fitting of standard column rackers to act as a racker device moveable in two dimensions according to the present disclosure.

Because the racker device can be parked or stowed in an offline position, the rig may provide direct access to the well center from a V-door for casing or other operational requirements. If the racker device is found to have mechanical issues, it can be returned to its parked or stowed position allowing a conventional diving board to be rotated into the horizontal position from its stowed vertical position and manual operations to commence.

The systems, devices, and methods possess numerous other advantages, and have other purposes which may be made more clearly apparent from the consideration of the attached embodiments. These embodiments are shown in the drawings accompanying this description. The embodiments will now be described in detail, for the purpose of illustrating the general principals of the systems, devices, and methods, but it is to be understood that one skilled in the art is not to be taken in a limiting sense, since the scope of the invention is best defined by the appended claims.

FIGS. 1 and 2 show a drilling rig system 100 as an apparatus of the present disclosure, with FIG. 1 showing a side profile and FIG. 2 showing a vertical profile of the system. Because of their mobile natures, mobile drilling rigs typically have small drill floors of about 35×35 feet. In some embodiments, the rig is smaller than about 1600 square feet. The system 100 may form a part of a mobile drilling rig having a drill floor size of about 35×35 ft, although larger and smaller rigs are contemplated. In other embodiments, the rig is smaller than about 1200 square feet. The system 100 disclosed herein is particularly useful because it permits a racker device to be used on rigs that are limited in size. As will be explained below, the system 100 is arranged to park in a position off-set from well center, or offset from a travel path between well center and a V-door, while being maintained on a standard sized mobile drilling rig. In some embodiments, the system 100 may build stands using an off-set mousehole in the drill floor. Therefore, the system 100 may operate more efficiently by permitting the well center operations, such as drilling, to be performed while building stands in a mousehole simultaneously. It may do this because the mousehole to build stands is offset and does not interfere with drilling operations. As such, the process of stand-building does not impact the rig's ability to perform drilling operations at well center. Additional details of the drilling rig system may be found in U.S. application Ser. No. 14/159,722, filed Jan. 21, 2014, incorporated herein in its entirety by express reference thereto.

The system 100 shown in FIGS. 1 and 2 includes a rig 101 with rig based structures and support 102 and a racker device 104 that operates on the rig based structures and support 102. The rig based structures and supports 102 include, for example, a mast 106, a fingerboard 108, a racker parking system 110, a diving board 112 stowed in a vertical position to allow system operation, an offline iron roughneck 114, well center 116, a well center roughneck 118, a drill floor mousehole 120, a left side offline mousehole 122, a right side offline mousehole 124, fingerboard support structure 126, and fingers 130 of the fingerboard 108. As used herein, the left side is the portion of the system on the left side of a center line 132 when looking from a V-door 134 on the rig 101 toward the well center 116 and the right side is the portion of the system 100 on the right side of the center line 132 when looking from the V-door 134 toward the well center 116.

The racker device 104 includes a modular racker hoist 142, a lower drive carriage 144, an upper drive carriage 146, and a racker support column 148. Drill pipe stands 150 are shown in FIGS. 1 and 2 and may be transferred by the racker device 104 on the rig based structures and supports 102 to positions in a mousehole for assembly or disassembly, transferred into and out of the fingerboard 108, and transferred into or out of the well center 116.

The racker support column 148 may be formed of a single beam or multiple beams and may be formed in single or multiple lengths joined together. In some embodiments, the racker support column 148 is a structural support along which the upper drive carriage 146 may move upward or downward on wheels, or other sliding, rolling, or advanceable interface.

The lower drive carriage 144 and the upper drive carriage 146 cooperate to manipulate tubulars and/or stands. The lower and upper drive carriages 144, 146 may respectively include a lower manipulator arm and gripper head 154 and an upper manipulator arm and gripper head 156. Each includes a manipulator arm 155 and a gripper head 157. The gripper heads 157 may be sized and shaped to open and close to grasp or retain tubing, such as tubulars or stands. The manipulator arms 155 may move the gripper heads 157 toward and away from the racker support column 148. These upper and lower manipulator arm and gripper heads 156, 154 are configured to reach out to insert a drill pipe stand into or remove a drill pipe stand from fingerboard 108. That is, the upper and lower manipulator arm and gripper heads 156, 154 extend outwardly in the y-direction from the racker support column 148 to clamp onto or otherwise secure a drill pipe stand that is in the fingerboard 108 or to place a drill pipe stand in the fingerboard. The upper drive carriage 146 may operate in a z-direction along the racker support column 148. The racker hoist 142 and may be configured to raise and lower the upper drive carriage 146 along the racker support column 148.

Figure 3:
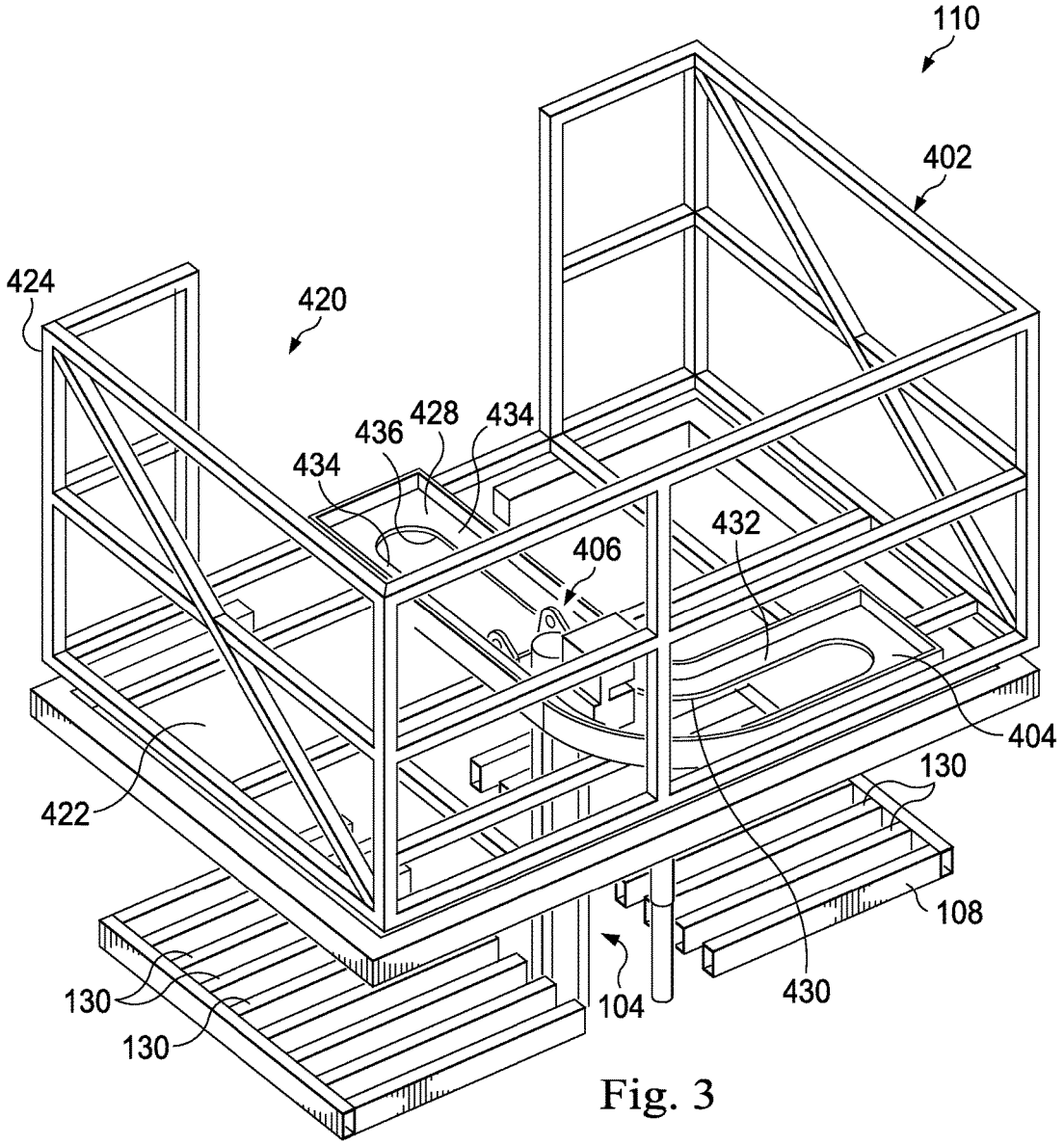
FIG. 3 is a schematic of an exemplary apparatus according to one or more aspects of the present disclosure showing an upper track portion.
Figure 4:
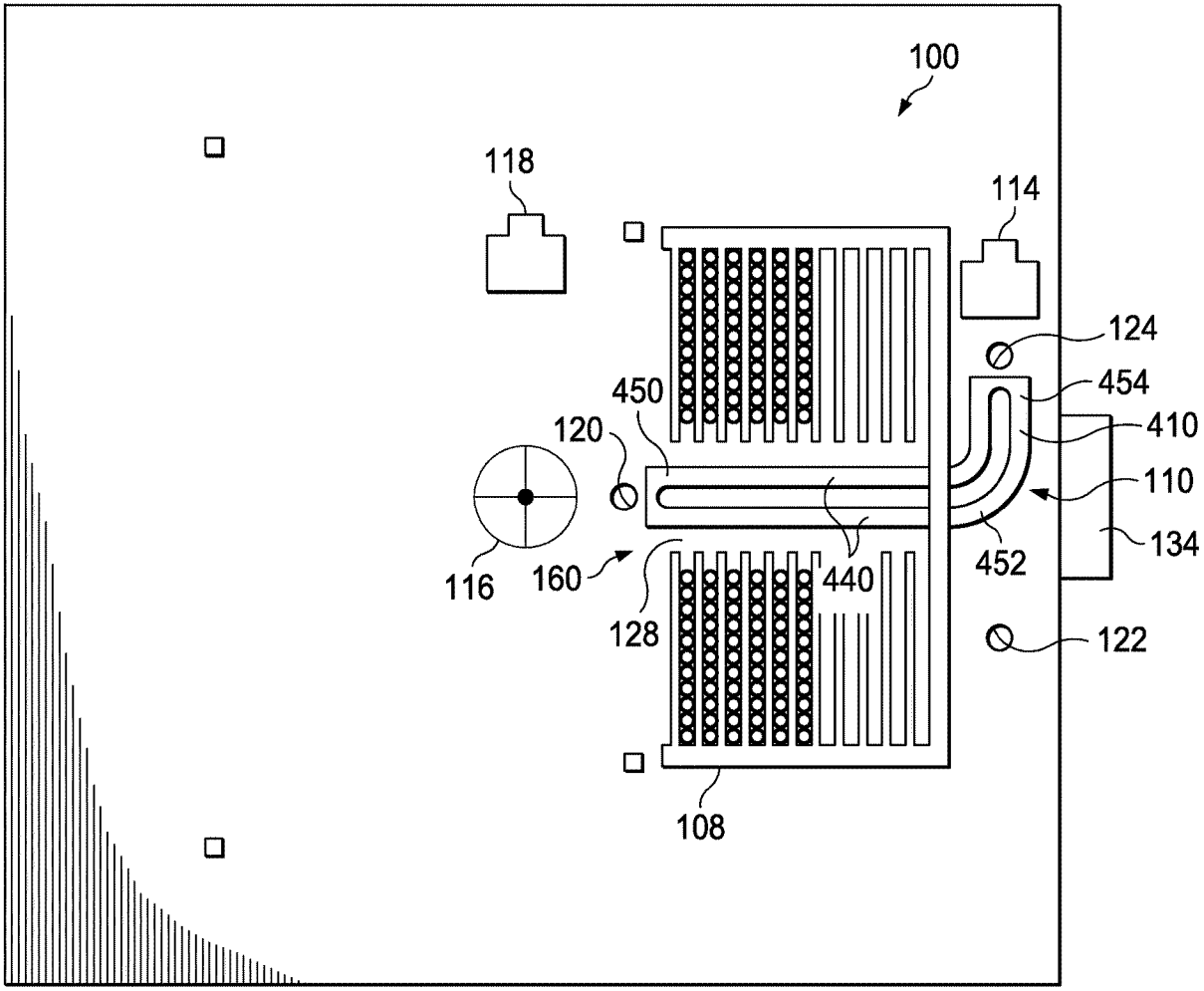
FIG. 4 is a schematic of a top view of the apparatus of FIG. 1 according to one or more aspects of the present disclosure showing a lower track portion.
Figure 5:
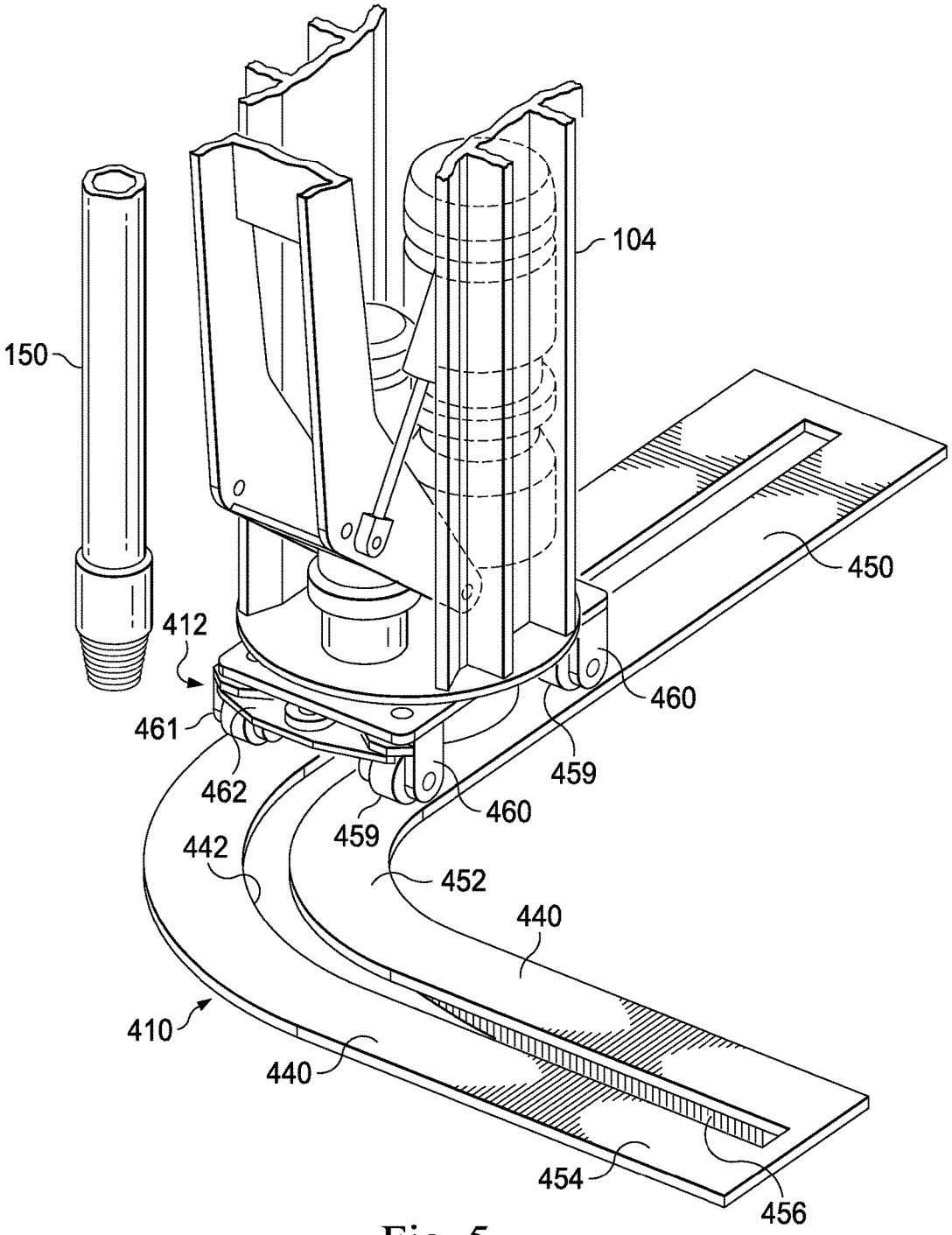
FIG. 5 is a schematic of an exemplary apparatus according to one or more aspects of the present disclosure showing a portion of the lower track portion of FIG. 4.
Figures 1, 6:
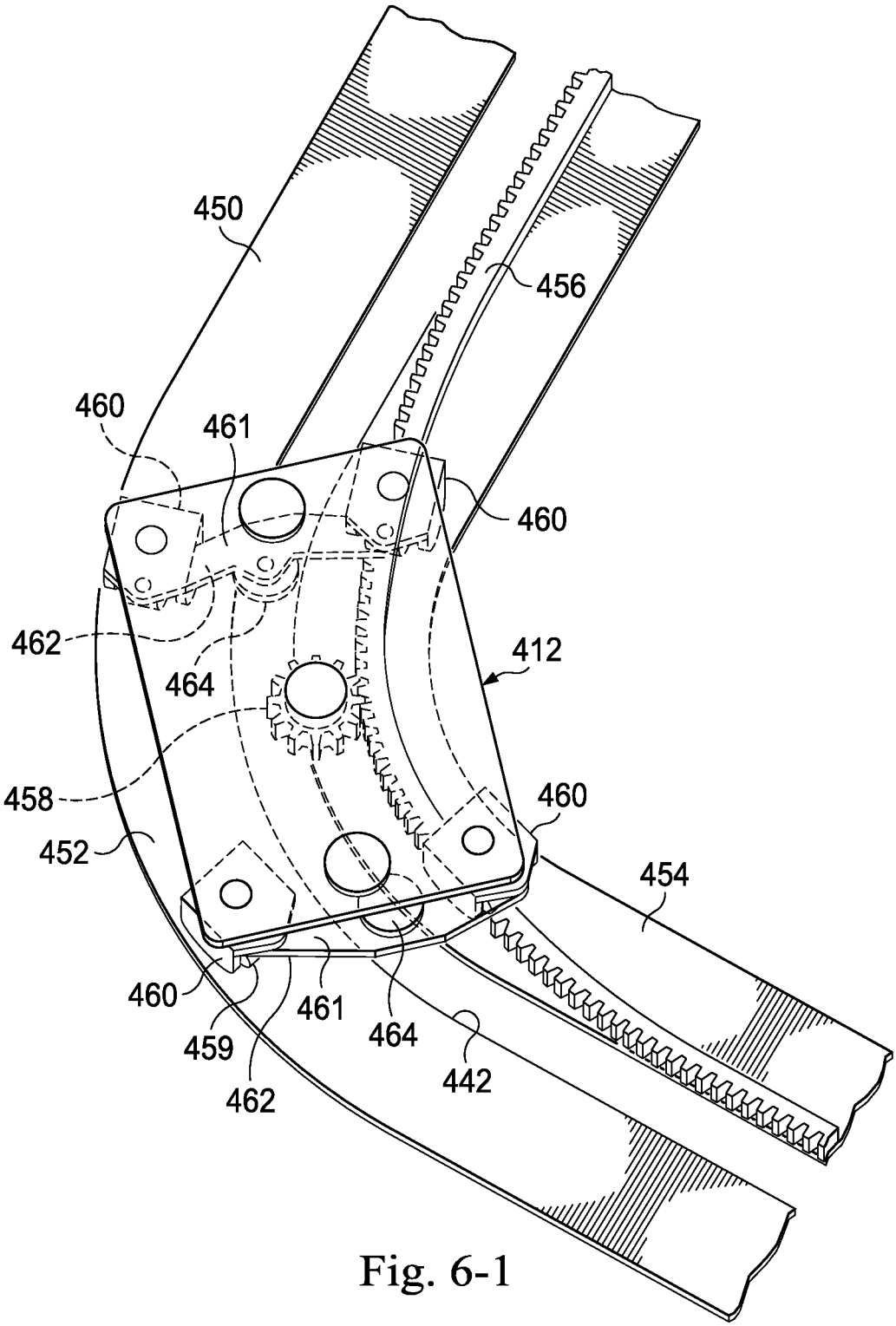
Figures 2, 6:
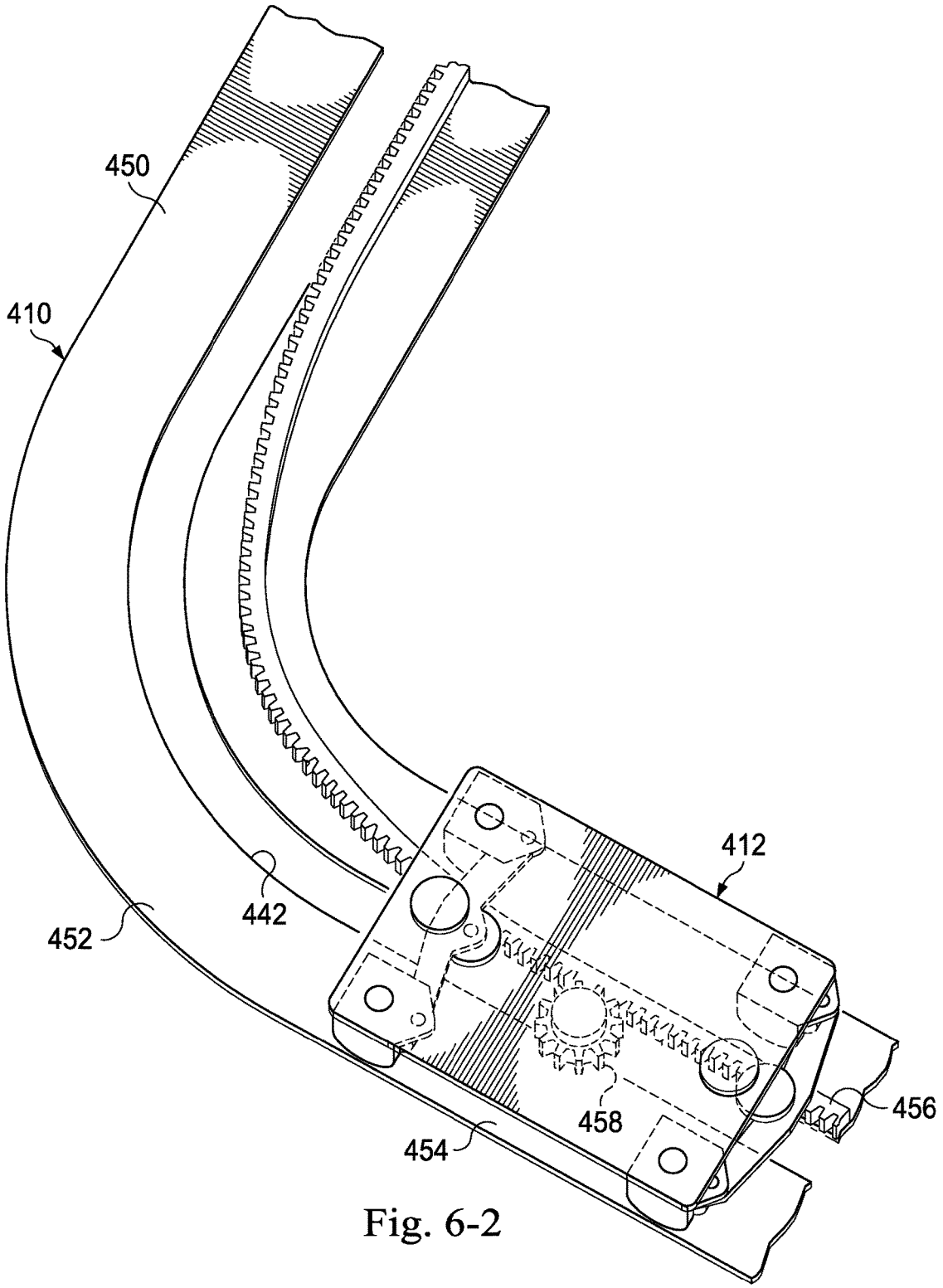

The fingerboard 108 is a rack formed of a plurality of fingers 130 spaced to receive pipe stands and maintain the pipe stands in a substantially vertical orientation. The fingers 130 extend in parallel, and in the embodiment shown, form a left side fingerboard portion 108*a* and a right side fingerboard portion 108*b*. These portions 108*a*, 108*b* in FIG. 2 are aligned so that the fingers 130 all extend in parallel lines in a direction substantially perpendicular to a line extending between well center 116 and a V-door 134. In other embodiments, the fingers 130 of each portion are parallel to each other and oblique to a line extending between well center 116 and a V-door 134. The spacing between the two portions 108*a*, 108*b* of the fingerboard 108 forms a gap 113 that provides a travel path for racker device 104 as it is carried by the parking system 110, as will be explained further below. The fingerboard support structure 126 is a frame support structure that supports the fingers and provides rigidity to the fingerboard 108. FIGS. 3 to 5, 6-1, and 6-2 show additional details of the racker parking system 110. FIG. 3 shows a portion of the racker parking system 110 with an upper support frame 402 having an upper track 404 and an upper trolley 406 that travels along the upper track 404. FIG. 4 shows a portion of the racker parking system 110 from a top view without the upper support frame 402 and without the racker device 104. It shows the lower track 410 of the racker parking system 110 relative to the fingerboard 108. FIG. 5 shows the lower track 410 with a lower trolley 412. FIGS. 6-1 and 6-2 show the lower track 410 with a portion of the lower trolley 412. The lower trolley 412 may carry or support the racker device 104, and in particular, may be directly connected to the lower drive carriage 144 (FIG. 1).

The upper support frame 402 in FIG. 3 includes a rig operator's nest 420 formed of a floor 422 with safety rails 424 disposed along its edges. The upper support frame 402 is disposed above the fingerboard 108 and is disposed at an elevation higher than the tops of stands that may be disposed in the fingerboard 108 or carried by the racker device 104. Other racker parking systems may be disposed at a lower elevation, including below the fingerboard 108. In FIG. 3, the floor 422 is partially transparent so that features below the floor may be visualized.

The upper support frame floor 422 includes the upper track 404 disposed therein having a straight segment 428 extending in an x-direction, an arced segment 430, and another straight segment 432 extending in a y-direction. The track 404 guides the upper trolley 406 as it moves during regular operation to displace tubulars or stands between the V-door and well center. It also guides the upper trolley 406 as it moves from a position online to a position offline, such as a parking position. In the offline position, the racker device 104 may build stands offline or may simply be parked in a position out of the line between the V-door and well center. Here the upper track 404 includes two extending support portions 434 separated by a slot 436. The support portions 434 extend in parallel and support the upper trolley 406. In this embodiment, the support portions 434 are formed of a part of the floor 422 and provide a track upon which the trolley 406 may move, such as a track along which wheels of the trolley 406 may roll. The slot 436 receives the upper trolley 406, which supports the racker assembly 104.

The straight segment 428 of the upper track 404 is disposed directly over the pathway between the fingerboard sides and in the direction of the V-door and well center. Accordingly, the straight segment 428 extends in the x-direction and allows the upper trolley 406 to move to a position where the racker device 104 can reach well center.

The curved segment 430 connects the straight segment 428 and the straight segment 432. In the embodiment shown, the curved segment 430 includes a constant radius and forms a 90 degree angle. However, because of the nature of the connection and the upper and lower trolleys 406, 412, the curved segment 430 may have a different radius, a different angle, or other arrangement.

The curved segment 430 is oriented relative to the fingerboard 108 to extend around the edge of the fingerboard. The straight segment 432 extends in a y-direction parallel to the fingers 130 of the fingerboard 108 and ends in a position where the racker device 104 is offline on the drilling rig. In this embodiment, the slot 436 includes smooth sides that allow the upper trolley 406 to smoothly move from the straight segment 428 extending in the online position to the transverse straight line segment 432 extending in the parked or offline position.

The trolley 406 may include wheels, rollers, sliding interfaces, or other engaging features that engage the top of the support portions 434, the bottom of the support portions 434, the edges of the slot 436, or two or more of these. Here, wheels 459 are shown. In some embodiments, the trolley 406 includes a portion that extends through the slot 436. This may guide the trolley 406 as it advances along the upper track 404. Some embodiments include a motor carried on the trolley 406 and may be arranged to power the trolley 406 to drive the trolley along the upper track 404.

FIG. 4 shows the lower track 410 relative to the fingerboard 108, and FIG. 5 shows the lower track 410 in greater detail with the racker device 104 disposed thereon. The lower track 410 matches the upper track 404 and is disposed directly below the upper track 404. It includes two support portions 440 separated by a slot 442. The support portions 440 extend in parallel and support the lower trolley 412 as it carries the racker device 104. In this embodiment, the support portions 440 are formed of a part of the rig floor and provide a track upon which wheels of the lower trolley 412 may roll. The slot 442 may receive a portion of the lower trolley 412, which supports the racker device 104.

Like the upper track 404, the lower track 410 includes a straight segment 450 extending in an x-direction, an arced segment 452, and another straight segment 454 extending in a y-direction. These segments are disposed directly below the corresponding segments in the upper track 404. The lower track 410 guides the lower trolley 412 as it moves during regular operation to displace tubulars or stands between the V-door and well center. It also guides the upper trolley 406 as it moves from a position online to a position offline.

FIGS. 6-1 and 6-2 show details of the lower track 410 that may be disposed below the track support portions 440. A similar track may be used as the upper track. For ease of visualizing, these figures show a part of the track support portions 440 and a part of the lower trolley 412 as partially transparent. This embodiment includes a drive system including a rack gear 456 and a pinion gear 458. In this embodiment, the lower track 410 includes the rack gear 456 meshed with the pinion gear 458 on the lower trolley 412. The rack gear 456 is disposed so that powering the pinion gear 458 drives the lower trolley 412 along the lower track 410 from any position along the track to any other position along the lower track, including from an online position to an offline or parked position. It should be understood that all movement from online to offline/parked positions may be reversed according to the present disclosure to position the same structure (e.g., trolley, fingerboard, etc.) back in an online position when appropriate.

In the exemplary embodiment shown, the lower trolley 412 includes wheeled casters 460 that allow the wheels to turn to follow the arced portion 452 of the lower track 410. In the embodiment shown, there are four casters 460, however any number of casters sufficient to support the weight of the racker device 104 and any other equipment may be used. Although wheels are shown, other rolling, sliding, or other interfaces may be employed. For example, the wheels may be replaced with sliding pads, rollers, slides, glides, grooves or other interfaces. In this embodiment, the pinion gear 458 is disposed substantially centrally within the lower trolley 412. It extends downwardly, through the slot 442 in the rig floor and engages the gear rack 456 on the underside of the track 410. Because of this, the distance from the slot edge to the gear rack 456 changes as is shown in FIGS. 6-1 and 6-2. In some embodiments, the slot 442 itself is arranged to follow the gear rack 456 and therefore may have a different concentricity than the support portions of the lower track 410. Some embodiments include a motor carried on the trolley 412 and may be arranged to power the lower trolley 412 to drive the trolley along the lower track 410.

In this embodiment, each trolley 406, 412 has an integrated wheel alignment system 461, best seen in FIG. 6-1. The wheel alignment system 461 connects wheels so that they operate as a set and cooperatively turn to follow the track 404, 410. This allows the trolley 406, 412 to make the turn around the curved segment to transition from the online direction (V-door to well center) to the offline direction (centerline to offline). In this embodiment shown relative to the lower track 410, the wheel alignment system 461 includes a yoke 462 that extends between each of the leading set of wheels and also has a guide 464 that extends down into the slot 442. Accordingly, as the lower trolley 412 advances along the track 410, the edges of the slot 442 interface with the guide 464 and force it to turn to follow the slot. The trailing set of wheels also includes a yoke 462 that connects the casters 460 and a guide 464 that interfaces with the slot 442 to maintain the lower trolley 412 on the lower track 410. The upper trolley 406 may operate in a similar manner. In other embodiments, the track support portions of either the upper and lower tracks 404, 410 is one or more rails that are engaged on one or both sides to guide the trolley 406, 412 as it moves. Other arrangements are also contemplated.

Figure 7:
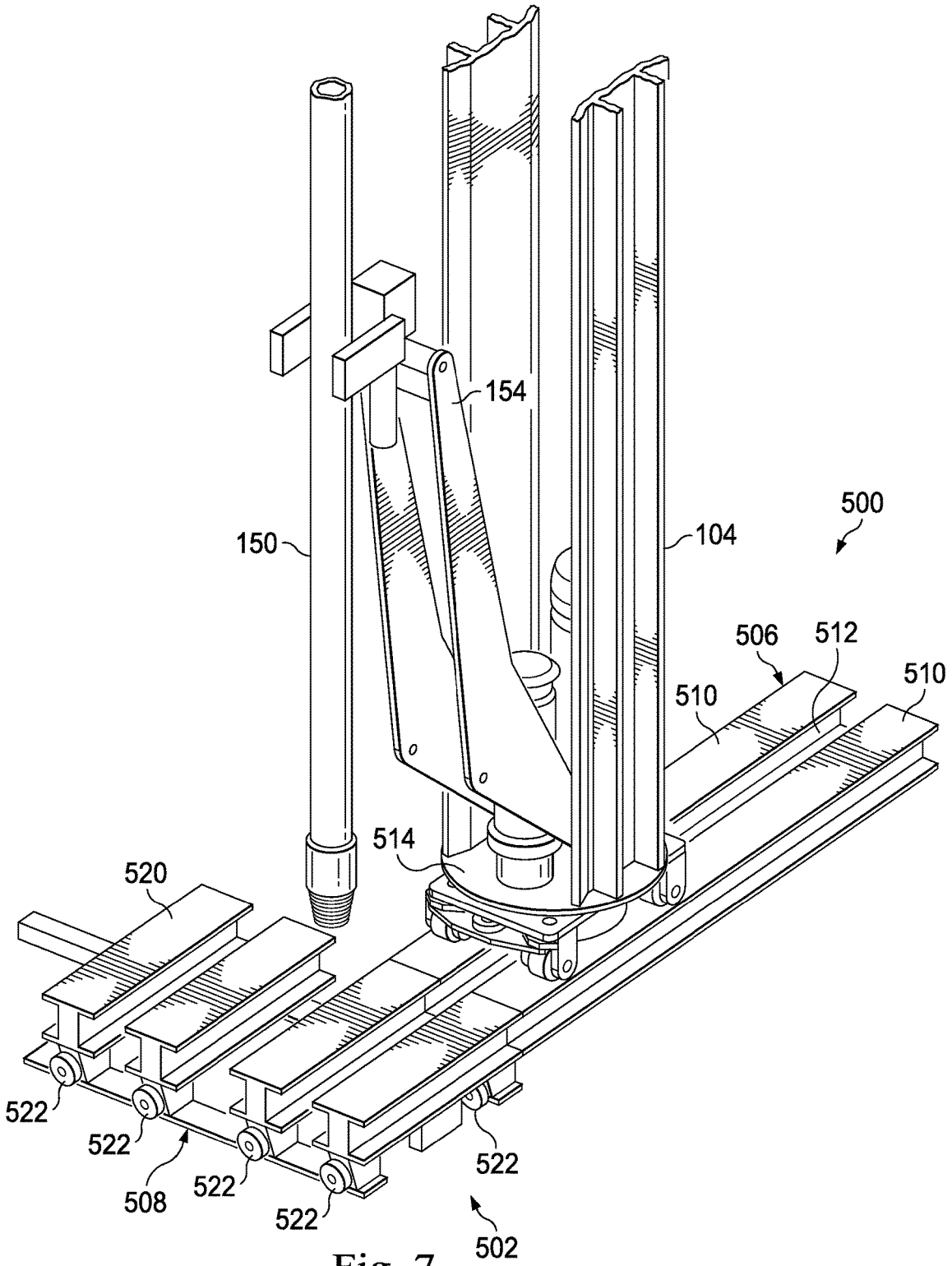
FIG. 7 is a schematic of an exemplary apparatus according to one or more aspects of the present disclosure showing an addition lower track portion.

FIGS. 7, 8, and 9-1 to 9-4 show another embodiment of a portion of a parking system 500 for moving the racker device 104 from an online position to an offline position. FIG. 7 shows a lower track 502 of the parking system 500 and FIGS. 8 and 9-1 to 9-4 show an upper track 504 of the parking system 500.

Referring to FIG. 7, the lower track 502 comprises an x-direction track portion 506 that extends between the V-door and well center and a y-direction track portion 508 extending at an angle transverse to the x-direction track portion. In this embodiment, the y-direction track portion 508 extends at a right angle from the x-direction track portion 506. The x-direction track portion 506 includes parallel rails 510 spaced to have a slot 512 formed therebetween. In some embodiments, the parallel rails 510 form a support portion upon which a lower trolley 514 may move. These may be disposed in the rig floor and may be flush with the rig floor.

The lower trolley 514 may ride along the x-direction track portion 506. Here, the lower trolley 514 travels in a straight line along the x-direction track portion 506. It may extend at least in part down below the upper surface of the rails 510, and in some embodiments, extends into the slot 512 between the rails 510 in the manner disclosed in other embodiments herein. The lower trolley 514 carries the racker device 104 to move it in the x-direction or the y-direction in the manner described herein. Here, the racker device 104 is shown with the column 148 and the lower gripper arm 154 holding an exemplary stand 150. The racker device 104 rotates on the lower trolley 514, and the lower trolley 514 moves along the x-direction track system between the V-door and well center on the rig. The lower trolley 514 includes wheels or other connectors to the x-direction track as discussed above.

The lower trolley 514 may travel in a straight line from the x-direction track portion 506 to the y-direction track portion 508. The y-direction track portion 508 includes a trolley parking portion 520 that selectively aligns with the x-direction track portion 506. However, this trolley parking portion 520 moves in the y-direction from a position aligned with the x-direction track portion 506 to a position laterally displaced from the x-direction track portion 506, or in other words, to an offline position. In the embodiment shown, the trolley parking portion 520 travels along the y-direction track portion 508 disposed at an elevation lower than the x-direction track portion 506. Accordingly, the trolley parking portion 520 includes wheels or casters 522 that enable it to travel along the y-direction track portion 508 in the y-direction. Other connections or rollers may also be used. In this embodiment, the trolley parking portion 520 may be connected to the y-direction track portion 508 so that the trolley parking portion 520 laterally translates to move the racker device 104 from the pathway between the V-door and well center to a parking position laterally displaced from the pathway.

Figure 8:
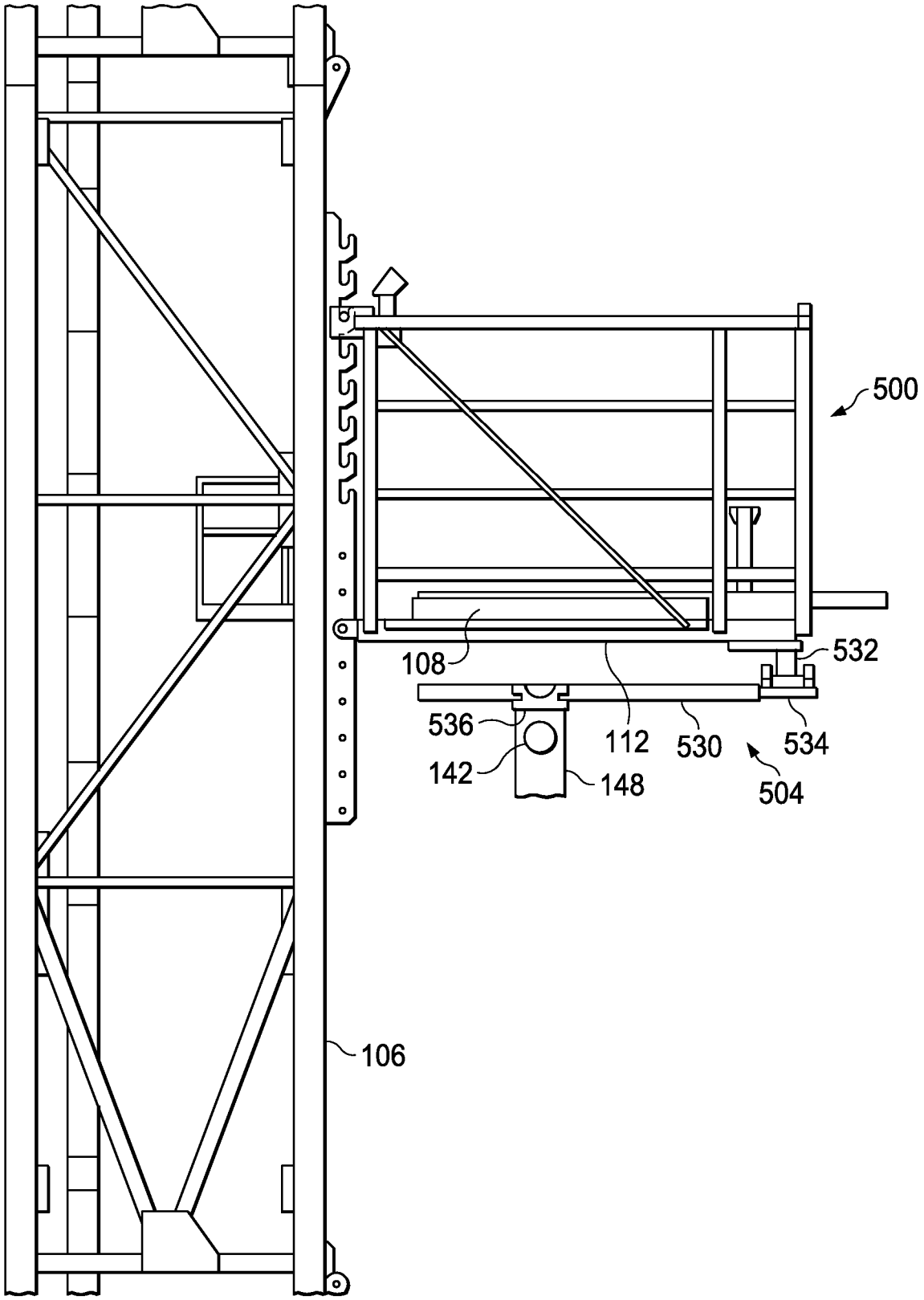
FIG. 8 is a schematic of a top view of an exemplary apparatus according to one or more aspects of the present disclosure.
Figures 1, 9:
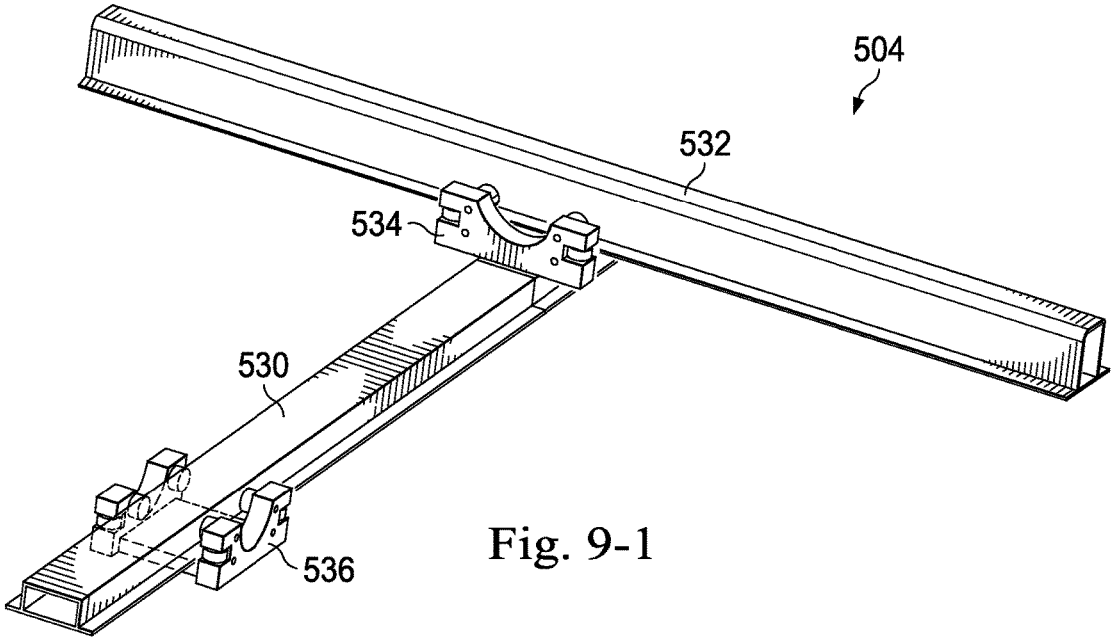
Figures 2, 9:
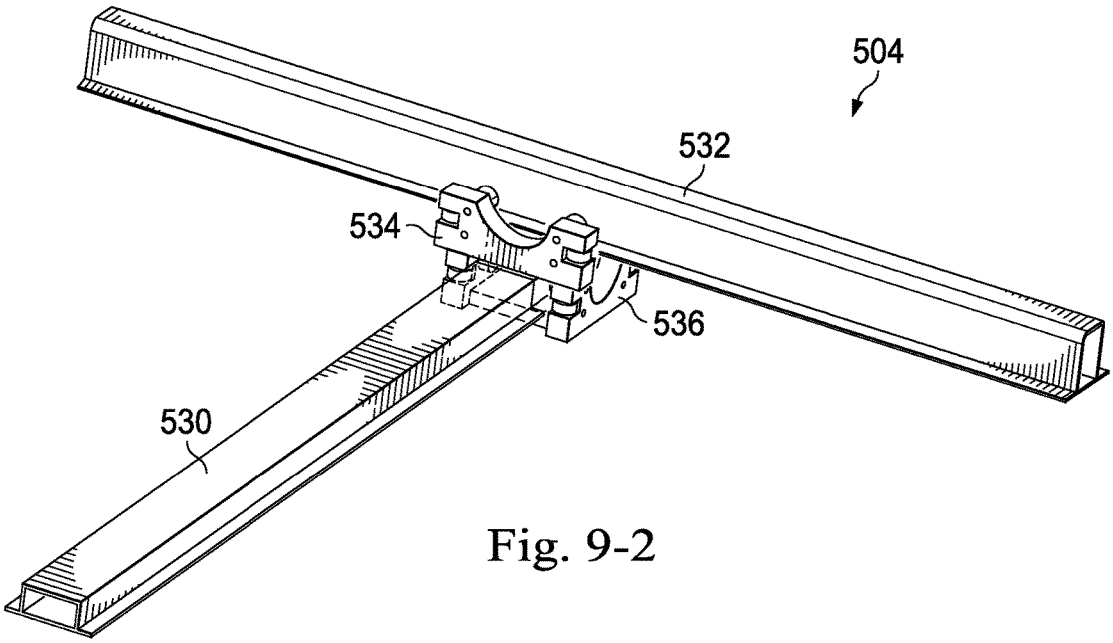
Figures 3, 9:
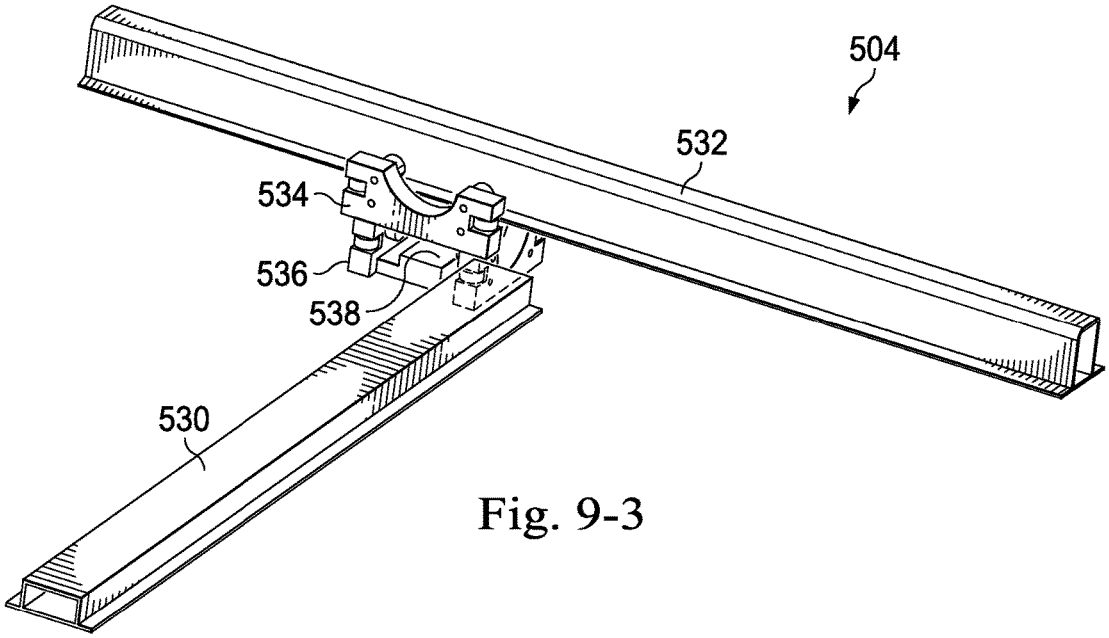
Figures 4, 9:
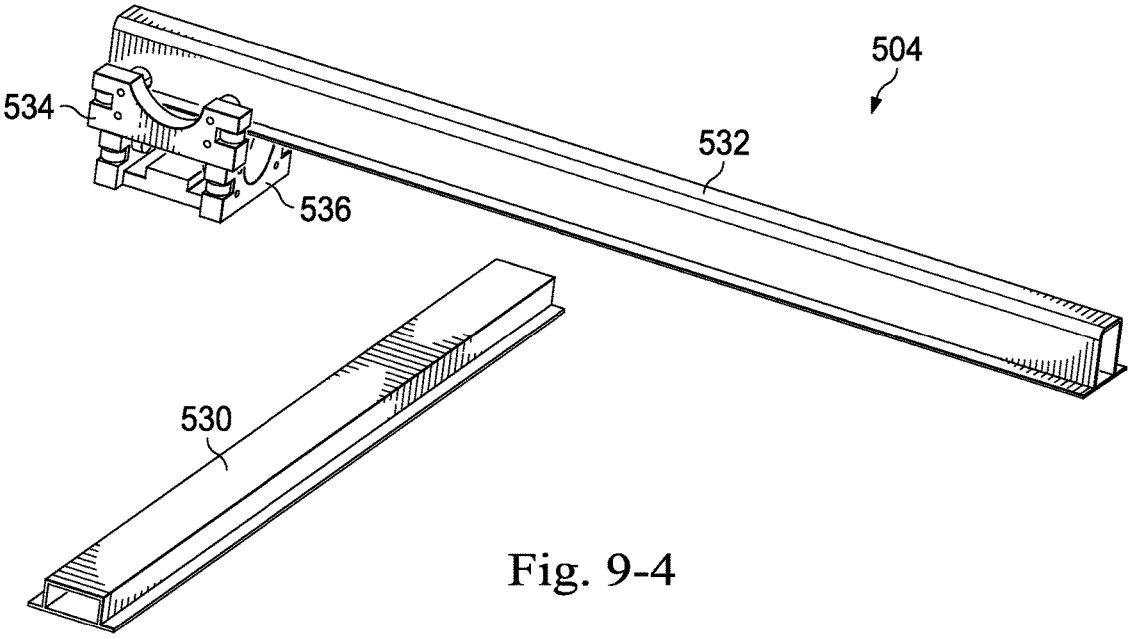

FIGS. 8 and 9-1 to 9-4 show the upper track 504 of the parking system 500. This may be used with the lower track 502 disclosed herein or with any other lower track. Here, the upper track 504 is disposed below the diving board 112 as shown in FIG. 8. Accordingly, it may be disposed at any elevation in any embodiment disclosed herein, including both above the diving board 112 as disclosed previously or below the diving board as disclosed here. Depending on the embodiment, the diving board 112 may have a kick down section. FIGS. 9-1 to 9-4 show the upper track 504 independent of most other structural factors. The upper track 504 includes a first track portion 530 extending in the x-direction and a second track portion 532 extending in the y-direction. These are each fixed in place relative to each other. The supporting structure is not represented in the drawings for clarity.

Depending on the embodiment, the x-direction track portion 530 and the y-direction track portion 532 are structural beams that may be disposed at a higher elevation or a lower elevation than the fingerboard 108. In some embodiments, the x-direction track portion 530 and the y-direction track portion 532 are disposed at a lower elevation than tops of stands within the fingerboard 108. For example, they may be disposed to be lower than a top of a triple stand. Other embodiments have the x-direction track portion 530 and the y-direction track portion 532 disposed at a higher elevation than tops of stands within the fingerboard 108. Although shown with a single support structure, other exemplary embodiments of the x-direction track portion 530 include two or more parallel support structures extending in an x-direction online with the pathway between the well center and the V-door. Similarly, other exemplary embodiments of the y-direction track portion 532 include two or more parallel support structures extending in an offline y-direction.

The parking system 500 also includes a trolley parking portion 534 and a racker trolley 536. The racker trolley 536 moves along the x-direction track portion 530 between the V-door and well center. The trolley parking portion 534 moves along the y-direction track portion 532 in a lateral direction. The racker device 104 (FIG. 1) connects to and is carried by the racker trolley 536 when the racker trolley moves along the x-direction track portion 536. The racker trolley 536, however, also is configured to selectively disconnect from the x-direction track portion 530 and connect to the trolley parking portion 534. The trolley parking portion 534 may then displace both the racker trolley 536 and the racker device 104 to an offline parking position.

FIGS. 9-1 to 9-4 show this process in detail. With reference to FIG. 9-1, the x-direction track portion 530 is disposed at a lower elevation than the y-direction track portion 532. In this embodiment, they are not directly connected to each other, although they are fixed to each other by a structure not shown. In the exemplary embodiment, the x-direction track portion 530 is a T-beam, and the racker trolley 536 is suspended under the x-direction track portion 530. The y-direction track portion 532 is disposed above and at an end of the x-direction track portion 530.

The y-direction track portion 532 extends transverse to the x-direction track portion 530. The y-direction track portion 532 is also a T-beam and the trolley parking portion 534 is suspended therefrom. As shown in FIG. 9-2, the racker trolley 536 may move to a position directly under the trolley parking portion 534. The trolley parking portion 534 may then directly connect to the racker trolley 536 and laterally displace along the y-direction track portion 532. The trolley parking portion 534 may carry the racker trolley 536 and the racker device 104 (not shown) in the lateral direction to an offline position on the rig.

In some embodiments, the trolley parking portion 534 and the racker trolley 536 are formed with meshing structures that permit them to mechanically connect and maintain connection as the racker trolley 536 disengages from the x-direction track portion 530. In some embodiments, these may be held together using other means, including being bolted or otherwise engaged. In some embodiments, the trolley parking portion 534 includes slots formed therein for receiving portions of the racker trolley 536 in a manner that secures the racker trolley 536 to the trolley parking portion 534. These may be connected using other methods or structural arrangements also. In some embodiments, one or both of the T-beams includes a slot that receives a guide 538 (in FIG. 9-3) projecting from the associated carriage in the manner discussed in other embodiments herein. The guide 538 extends into the slot of the T-beam and provides stability and guidance to the carriage. The guide 538 may act to mechanically help or guide the carriage as it moves along the associated rail. Any feature of the trolleys discussed herein may be used with any of the other trolleys. For example, any of the trolleys disclosed herein may include a motor or other feature that might help drive it along the pathway.

FIG. 9-4 shows the carriages in a parking position. In this position, the racker trolley, and therefore the racker device 104, is entirely separate from the x-direction track portion 530 and has been carried in the y-direction to an offline position.

Figure 10:
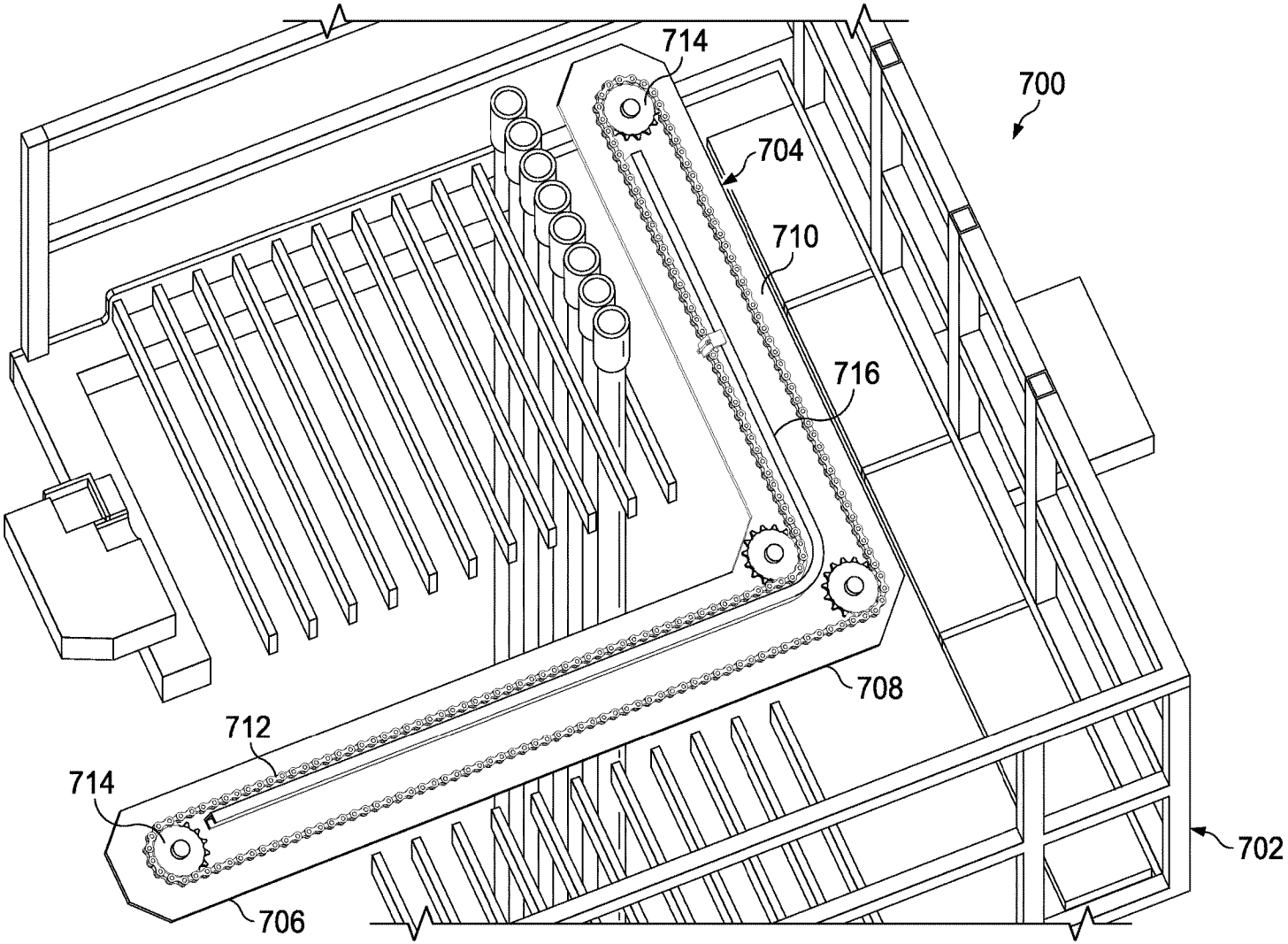
FIG. 10 is a schematic of an exemplary apparatus according to one or more aspects of the present disclosure showing a portion of a rig with an upper track portion.
Figure 12:
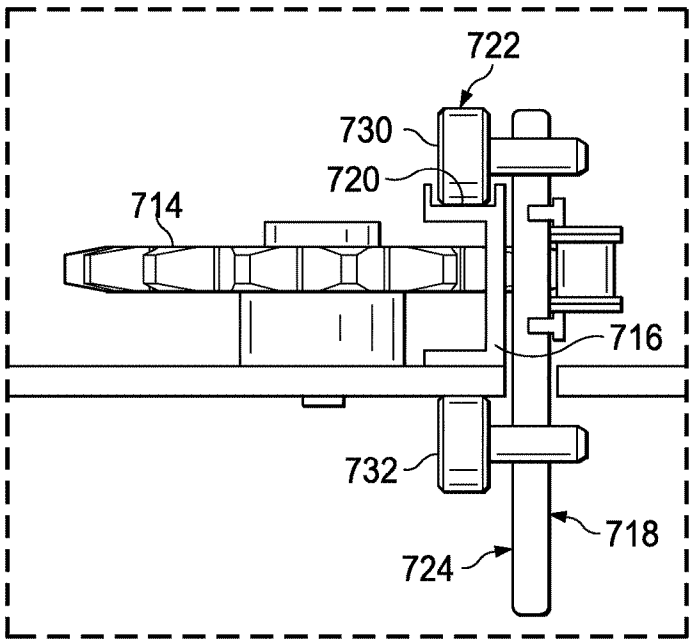
FIG. 12 is a schematic of an exemplary apparatus according to one or more aspects of the present disclosure showing a portion of the track portion of FIG. 10.
Figure 11:
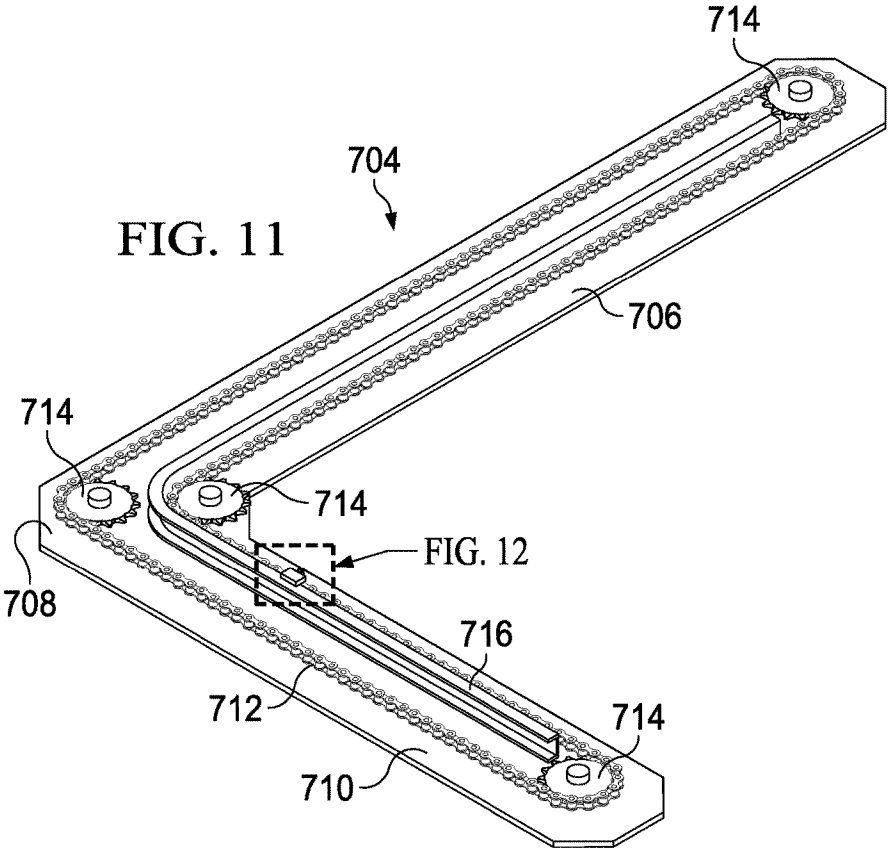
FIG. 11 is a schematic of an exemplary apparatus according to one or more aspects of the present disclosure showing the track portion of FIG. 10 independent of the rig.

FIGS. 10-12 illustrate an embodiment of a parking system 700 that utilizes a track portion with a flexible drive system that enables the racker device 104 to travel around an arced segment from an online to an offline position and vice versa. Much of the discussion of the other embodiments applies equally to the embodiment in FIGS. 10-12 and will not be repeated here.

FIG. 10 shows an upper support frame 702 that includes an upper track 704 disposed therein having a straight segment 706 extending in an x-direction, an arced segment 708, and another straight segment 710 extending in a y-direction. The track 704 guides the upper trolley (FIG. 3) as it moves during regular operation to displace tubulars or stands between the V-door and well center. It also guides the upper trolley as it moves from a position online to a position offline, such as a parking position. In the offline position, the racker device 104 (FIG. 2) may build stands offline or may simply be parked in a position out of the line between the V-door and well center.

In this embodiment, the upper and/or lower trolleys of the racker device 104 ties into a track, such as the upper track 704 and into a drive belt for travel along the different segments of the track 704. The same system may be used for a lower track, and only the upper track will be described. The drive system includes a drive belt 712, a plurality of drive wheels 714, a guide 716, and a trolley connection portion 718.

The drive belt 712 may be flexibly formed to bend around the drive wheels 714 and extend along the track 704. In this embodiment, the drive belt 712 extends along both sides of the guide 716. However, the path of the drive belt 712 may vary, and although shown with an L-shaped configuration, some embodiments of the drive belt 712 are configured in a rectangular loop, a triangular loop, or other configuration. The drive belt 712 may follow any path as dictated by the location of the drive wheels 714. The drive belt 712 may be configured to flex and bend to extend around the drive wheels 714. In some embodiments, the drive belt 712 is formed of a sufficiently strong yet flexible material such a polymeric material, a rope or cable, or a chain. In the embodiments shown the drive belt 714 is a drive chain having links connected together in a manner that receives sprocket teeth of the drive wheels 714. Other embodiments have different arrangements.

The drive wheels 714 may be pulleys, such as sheaves, gears, sprockets, or other wheel that rotates and is configured to support and guide the direction of the drive belt 712. In some embodiments, the drive wheels 714 do not rotate, but are a fixed structure about which the drive belt 712 may slide. In this embodiment, the drive wheels 714 are sprocket type drive wheels that engage links of the drive belt 712 and help carry the drive belt 714. Although four drive wheels 714 are shown in FIGS. 10 and 11, other embodiments include a different number of drive wheels with different configurations. In some embodiments, one or more of the drive wheels 714 functions as a driver driven by an electric or hydraulic motor, gearbox, and/or brake combination (not shown) associated therewith. The motor may turn the driver 714 to advance or retract the drive belt and move the trolley carrying the racker device. Some embodiments include a measuring element, such as an encoder, to sense the position of the sprocket to track movement and position of the drive belt 712. It may be coupled to one or more of the drive wheels 714. Other tracking arrangements may be used to determine the position of the racker device 104. Some embodiments include a load bearing guide for the trolley.

The guide 716 may be a track along which the trolley connection portion 718 may travel. As seen in FIGS. 11 and 12, the guide 716 extends along the track 704 and provides a travel path for the connection portion 718 (FIG. 12). Here, the guide 716 is a C-shaped structure including a race 720 for a bearing or wheel of the connection portion 718. The guide 716 extends along the same path as the drive belt 712 so that as the drive belt 712 moves, the connection portion 718 moves along the guide 716.

The connection portion 718 in this embodiment includes a guide engaging portion 722 and a drive link 724. The guide engaging portion 722 travels along the guide 716 and provides support and stabilization. In this embodiment, the guide engaging portion 722 comprises an upper roller 730 and a lower roller 732. The upper roller 730 travels in the race of the guide 716, and the lower roller 732 travels on the underside of the track 704. The drive link 724 connects the guide engaging portion 722 to the racker device 104. Accordingly, in the embodiment shown, the drive link 724 extends through a slot in the track 704. The racker device 104 connects to and is supported by the drive link 724. Other arrangements are contemplated. In some embodiments, the drive link 724 comprises a projection that protrudes above or below the track 704. In some embodiments, the drive link 724 is directly affixed to the drive belt 712. This drive link 724 may engage with the trolley of the racker device 104 to drive its motion along the track segments.

Another embodiment includes a trolley that selectively engages the drive belt 712. In one such embodiment, the trolley grabs the drive belt 712 with clamping devices to selectively engage and disengage from the drive belt. In some of these embodiments, two such clamping devices may be oriented at 90 degrees to one another, one each for grapping onto the flexible drive belt for travel in the x- and y-directions. In some embodiments, when the trolley reaches the 90 degree turn, one clamp releases, and the other engages to allow the direction to change from the x to the y direction or vice versa. Depending on any drive belt embodiment herein, the drive belt may drive the trolley on either an inner or an outer path.

A particular advantage of the parking systems disclosed herein is that in the event of a failure of the racker device 104, it can be moved to a parked or stowed position that is offline and is not disposed between the V-door and the well center 116. Accordingly, even while the racker device 104 is down for repair or maintenance, the drilling operation can continue using a conventional diving board and rig crew personnel (not shown).

The systems and methods disclosed herein may be used to convert a conventional mobile drilling rig to a drilling rig having a parking system as disclosed herein. This may be done by installing the different components of the parking system on the conventional drilling rig. For example, converting a conventional drilling rig may include installing an upper track portion on the mast of the conventional drilling rig. This may include attaching the support columns via a welding process, a bolting process, or a combination of both processes to secure the upper track portion in place. In some embodiments, this includes installing the x-direction track portion in a position aligned with the pathway between the V-door and well center. Naturally, this may be above the rig floor as described herein. This may be installed at an elevation higher than the top of stands that may be maintained within a fingerboard. In some embodiments, this may also include pivoting a diving board from a horizontal position to a vertical position to provide sufficient space for the racker device 104. In other embodiments, it includes removing the diving board entirely. In other embodiments, the x-direction track portion is installed below the fingerboard.

The y-direction track portion may also be installed. This may be disposed transverse to the x-direction track, and in some embodiments, is perpendicular to the x-direction track. It may be positioned in the manner disclosed herein, and may be disposed between an edge of the drilling rig and the fingerboard. Depending on the embodiment, a curved section may also be installed. The entire upper track may be installed as a single piece, or may be installed in modular pieces.

The lower track portion may be installed on the rig floor of the conventional drilling rig. This may include replacing portions of the drilling rig floor to accommodate the rails and gaps that may be associated with lower tracks disclosed herein. In some embodiments, these are flush with the floor of the drilling rig. In other embodiments, these are installed as a subfloor on the conventional rig floor. Depending on the embodiment, this may include installing the x-direction, the y-direction track portion, and the curved direction track portion. Other embodiments are installed using the transverse tracks with a translatable portion. In these embodiments, the track portions may be at different elevations.

Next, upper and lower carriages are attached to the upper and lower tracks. This may include connecting the carriages so that they are securely maintained on the tracks. In some embodiments, this includes attaching the carriages to drive structures, such as gears or other drive structures. The trolleys may be installed to follow a curved track or may be installed to translate on trolley parking portions in the manner disclosed herein.

Although described with the offline position being adjacent the v-door side of the rig, other embodiments having the offline position being on the opposing side of the fingerboard on the side adjacent well center.

In view of all of the above and the figures, one of ordinary skill in the art will readily recognize that the present disclosure introduces an apparatus comprising: a first track portion extending along a pathway between a well center and a V-door on a drilling rig; a second track portion extending in a transverse direction relative to the first track portion, the second track portion extending to a position offline relative to the pathway between the well center and the V-door on a drilling rig; a curved track portion connecting the first track portion and the second track portion; and a trolley configured to carry a racking device and configured to move along at least a portion of the first track portion, the second track portion, and the curved track portion between a position in the pathway between a well center and a V-door on a drilling rig and a position offline and out of the pathway between well center and a V-door on a drilling rig.

In an aspect, the trolley comprises wheels that roll along at least a portion of the first track portion, the second track portion, and the curved track portion, the wheels being configured to turn to follow the curved track portion. In an aspect, the trolley comprises a set of wheels connected together in a manner that keeps them aligned as they turn to follow the curved track portion. In an aspect, the first track portion, the second track portion, and the curved track portion include a slot disposed therein, the trolley having a portion extending through the slot to guide the trolley as it moves along at least a portion of the first track portion, the second track portion, and the curved track portion. In an aspect, the apparatus comprises a drive mechanism associated with the trolley to drive the trolley along at least a portion of the first track portion, the second track portion, and the curved track portion. In an aspect, the drive mechanism comprises: a rack gear extending along at least a portion of the first track portion, the second track portion, and the curved track portion; and a motor driving a pinion gear engaged with the rack gear, wherein turning the pinion gear advances the trolley along at least a portion of the first track portion, the second track portion, and the curved track portion. In an aspect, the pinion gear is centrally disposed on the trolley and extends through a slot in the first track portion, the second track portion, and the curved track portion. In an aspect, the second track portion is positioned to extend along a side of a racking fingerboard. In an aspect, the first track portion, the second track portion, and the curved track portion are all flush with the rig floor. In an aspect, a drive belt extends along at least a portion of the first track portion, the second track portion, and the curved track portion, the trolley being cooperatively connected to the drive belt in a manner that the drive belt moves the trolley along least a portion of the first track portion, the second track portion, and the curved track portion.

One of ordinary skill in the art will readily recognize that the present disclosure introduces an apparatus comprising: a first track portion extending along a pathway between a well center and a V-door on a drilling rig; a second track portion extending in a transverse direction relative to the first track portion, the second track portion extending to a position offline relative to the pathway between the well center and the V-door on a drilling rig; a trolley parking portion aligned with one of the first track portion and the second track portion and translatable along the other of the first track portion and the second track portion; and a trolley moveable along the one of the first track portion and the second track portion aligned with the trolley parking portion, the trolley being configured to be carried on the trolley parking portion when the trolley parking portion is moved along the other of the first track portion and the second track portion.

In an aspect, the first track portion comprises a single rail extending in a first direction and the second track portion comprises a single rail extending in a transverse direction. In an aspect, the second track portion is fixed in place relative to the first track portion and is disposed at an end of the first track portion. In an aspect, the trolley parking portion comprises parking rails moveable along the second track portion. In an aspect, the parking rails comprise parallel rails extending along the pathway between the well center and the V-door on the drilling rig, and wherein the parallel rails are translatable along the second track portion. In an aspect, the apparatus comprises parallel rails extending in the transverse direction, and the trolley parking portion is configured to travel along the parallel rails. In an aspect, the first track portion and the second track portion are substantially straight and substantially perpendicular to each other. In an aspect, the trolley is configured to selectively attach to the trolley parking portion and the trolley parking portion is configured to carry the trolley. In an aspect, the trolley is configured to selectively engage with the one of the first track portion and the second track portion and is configured to selectively disengage therefrom and engage with the trolley parking portion. In an aspect, a drive belt extends along at least a portion of the first track portion, the second track portion, and the curved track portion, the trolley being cooperatively connected to the drive belt in a manner that the drive belt moves the trolley along least a portion of the first track portion, the second track portion, and the curved track portion.

One of ordinary skill in the art will readily recognize that the present disclosure introduces a method of installing a parking system for a racker device on a mobile drilling rig, comprising: installing a first track portion extending along a pathway between a well center and a V-door on a drilling rig; installing a second track portion extending in a transverse direction relative to the first track portion, the second track portion extending to a position offline relative to the pathway between the well center and the V-door on a drilling rig; installing a curved track portion connecting the first track portion and the second track portion; and attaching a trolley to the first track portion, the second track portion, and the curved track portion so that the trolley can move between a position in the pathway between a well center and a V-door on a drilling rig and a position offline and out of the pathway between well center and a V-door on a drilling rig.

In an aspect, the first track portion, the second track portion, and the curved track portion include a slot disposed therein, and wherein attaching a trolley to the first track portion, the second track portion, and the curved track portion comprises arranging the trolley so that a portion of the trolley extends through the slot. In an aspect, attaching a trolley to the first track portion, the second track portion, and the curved track portion comprises engaging a gear on the trolley to a gear adjacent one of the first track portion, the second track portion, and the curved track portion.

One of ordinary skill in the art will readily recognize that the present disclosure introduces a method of installing a parking system for a racker device on a mobile drilling rig, comprising: installing a first track portion extending along a pathway between a well center and a V-door on a drilling rig; installing a second track portion extending in a transverse direction relative to the first track portion, the second track portion extending to a position offline relative to the pathway between the well center and the V-door on a drilling rig; aligning a trolley parking portion with one of the first track portion and the second track portion in a manner that the trolley parking portion is moveable along the other of the first track portion and the second track portion; and attaching a trolley to one of the first track portion and the second track portion, the trolley being configured to be carried on the trolley parking portion when the trolley parking portion is moved along the other of the first track portion and the second track portion.

In an aspect, the trolley parking portion comprises parking rails moveable along the second track portion. In an aspect, the parking rails comprise parallel rails extending along the pathway between the well center and the V-door on the drilling rig, and wherein the parallel rails are translatable along the second track portion. In an aspect, installing a second track portion comprises installing the second track portion perpendicular to the first track portion. In an aspect, the trolley parking portion is configured to carry the trolley.

One of ordinary skill in the art will readily recognize that the present disclosure introduces an apparatus that includes a first track portion extending along a pathway between a well center and a V-door on a drilling rig and includes a second track portion extending in a transverse direction relative to the first track portion. The second track portion extends to a position offline relative to the pathway between the well center and the V-door on the drilling rig. A trolley parking portion is translatable along one of the first track portion and the second track portion. A trolley is moveable along the other of the first track portion and the second track portion. The trolley is selectively attachable to the trolley parking portion and configured to be carried by the trolley parking portion when the trolley parking portion is moved along said one of the first track portion and the second track portion.

In an aspect, the trolley disengages from said other of the first track portion and the second track portion when attached to the trolley parking portion. In an aspect, the first track portion extends at a different elevation than the second track portion.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112, paragraph 6 for any limitations of any of the claims herein, except for those in which the claim expressly uses the word "means" together with an associated function.

What is claimed is:

1. An apparatus comprising:

a first lower track portion extending along a pathway between a well center and a V-door on a drilling rig;

a second lower track portion extending in a transverse direction relative to the first lower track portion, the second lower track portion extending to a position offline relative to the pathway between the well center and the V-door on the drilling rig;

a curved lower track portion disposed between the first lower track portion and the second lower track portion;

a lower trolley configured to carry a racker device, the lower trolley coupled to a lower portion of the racker device and configured to move along at least a portion of the first lower track portion, the second lower track portion, and the curved lower track portion between a position in the pathway between the well center and the V-door on the drilling rig and a position offline and out of the pathway between well center and the V-door on the drilling rig;

a first upper track portion extending along the pathway between the well center and the V-door on a drilling rig;

a second upper track portion extending in a second direction transverse to the pathway, the second upper track portion extending to a position offline relative to the pathway;

a curved upper track portion disposed between the first upper track portion and the second upper track portion; and an upper trolley disposed at an upper portion of the racker device, the upper trolley configured to move along at least a portion of the first upper track portion, the second upper track portion, and the curved upper track portion, wherein the racker device extends between the lower trolley and the upper trolley.

2. The apparatus of claim 1, wherein the lower trolley comprises wheels that roll along the first lower track portion, the second lower track portion, and the curved lower track portion, the wheels being configured to turn to follow the curved lower track portion.

3. The apparatus of claim 2, wherein the lower trolley comprises a set of wheels connected together in a manner that keeps them aligned as they turn to follow the curved lower track portion.

4. The apparatus of claim 1, wherein the first lower track portion, the second lower track portion, and the curved lower track portion include a slot disposed therein, the lower trolley having a portion extending through the slot to guide the lower trolley as it moves along the first lower track portion, the second lower track portion, and the curved lower track portion.

5. The apparatus of claim 1, further comprising a drive mechanism associated with the lower trolley to drive the lower trolley along at least a part of the first lower track portion, the second lower track portion, and the curved lower track portion.

6. The apparatus of claim 5, wherein the drive mechanism comprises:

a rack gear extending along the first lower track portion, the second lower track portion, and the curved lower track portion; and a motor driving a pinion gear engaged with the rack gear, wherein turning the pinion gear advances the lower trolley along at least a portion of the first lower track portion, the second lower track portion, and the curved lower track portion.

7. The apparatus of claim 6, wherein the pinion gear is centrally disposed on the lower trolley and extends through a slot in the first lower track portion, the second lower track portion, and the curved lower track portion.

8. The apparatus of claim 1, wherein the second lower track portion is positioned to extend along a side of a racker fingerboard.

9. The apparatus of claim 1, wherein the first lower track portion, the second lower track portion, and the curved lower track portion are all flush with a rig floor.

10. The apparatus of claim 1, wherein the first lower track portion is positioned under the first upper track portion, the second lower track portion is positioned under the second upper track portion, and the curved lower track portion is positioned under the curved upper track portion.

11. The apparatus of claim 10, wherein the first lower track portion has the same dimensions as the first upper track portion, the second lower track portion has the same dimensions as the second upper track portion, and the curved lower track portion has the same dimensions as the curved upper track portion.

12. The apparatus of claim 1, wherein each of the first lower track portion, the second lower track portion, and the curved lower track portion extend along a rig floor.

13. The apparatus of claim 1, wherein the racker device is a column racker and the lower trolley bears the weight of the column racker.

14. A method of installing a parking system for a racker device on a mobile drilling rig, comprising:

installing a first track portion extending along a pathway between a well center and a V-door on the drilling rig;

installing a second track portion extending in a transverse direction relative to the first track portion, the second track portion extending to a position offline relative to the pathway between the well center and the V-door on the drilling rig;

installing a curved track portion connecting the first track portion and the second track portion;

attaching a trolley to an upper portion of the racker device; and attaching the trolley to the first track portion, the second track portion, and the curved track portion so that the trolley can move between a position in the pathway between the well center and the V-door on the drilling rig and a position offline and out of the pathway between the well center and the V-door on the drilling rig.

15. The method of claim 14, wherein the first track portion, the second track portion, and the curved track portion include a slot disposed therein, and wherein attaching the trolley to the first track portion, the second track portion, and the curved track portion comprises arranging the trolley so that a portion of the trolley extends through the slot.

16. The method of claim 14, wherein attaching the trolley to the first track portion, the second track portion, and the curved track portion comprises engaging a gear on the trolley to a gear adjacent one of the first track portion, the second track portion, and the curved track portion.

17. The method of claim 14, further comprising:

installing a third track portion extending along between the well center and the V-door on the drilling rig;

attaching a lower trolley to a lower portion of the racker device; and attaching the lower trolley to the third track portion.

18. The method of claim 17, further comprising:

installing a fourth track portion extending in a transverse direction relative to the third track portion, the fourth track portion extending to a position offline relative to the pathway between the well center and the V-door on the drilling rig;

installing a second curved track portion connecting the third track portion and the fourth track portion; and attaching the lower trolley to the third track portion, the fourth track portion, and the second curved track portion so that the lower trolley can move between a position in the pathway between the well center and the V-door on the drilling rig and a position offline and out of the pathway between the well center and the V-door on the drilling rig.

19. The method of claim 18, further comprising:

installing the third track portion below the first track portion;

installing the fourth track portion below the second track portion; and installing the second curved track portion below the curved track portion.

20. The method of claim 17, wherein installing the third track portion includes installing along a rig floor between the well center and the V-door on the drilling rig.

21. An apparatus comprising:

a first track portion extending along a pathway between a well center and a V-door on a drilling rig;

a second track portion extending in a transverse direction relative to the first track portion, the second track portion extending to a position offline relative to the pathway between the well center and the V-door on the drilling rig;

a curved track portion disposed between the first track portion and the second track portion; and an upper trolley configured to carry a racker device, the upper trolley coupled to an upper portion of the racker device and configured to move along at least a portion of the first track portion, the second track portion, and the curved track portion between a position in the pathway between the well center and the V-door on the drilling rig and a position offline and out of the pathway between the well center and the V-door on the drilling rig.

22. The apparatus of claim 21, further comprising a third track portion, wherein a lower trolley coupled to a lower portion of the racker device is configured to move along at least a portion of the third track portion.

23. The apparatus of claim 22, wherein the racker device extends as a vertical column between the lower trolley and the upper trolley.

24. The apparatus of claim 23, wherein the third track portion extends along a rig floor.

25. The apparatus of claim 22, wherein the third track portion extends along a rig floor.

* * * * *